US006160972A

United States Patent [19]

Shimazu et al.

[11] Patent Number: 6,160,972

[45] Date of Patent: Dec. 12, 2000

[54] IMAGE FORMING APPARATUS

[75] Inventors: Fumio Shimazu, Nara; Katsuhiro Nagayama, Yamabe-gun, both of Japan

[73] Assignee: Sharp Kabushiki Kaisha, Osaka, Japan

[21] Appl. No.: 09/443,528

[22] Filed: Nov. 19, 1999

[30] Foreign Application Priority Data

Nov. 25, 1998 [JP] Japan ..... 10-333464

[51] Int. Cl.[7] ..... G03G 15/16

[52] U.S. Cl. ..... 399/66; 399/72; 399/299; 399/303

[58] Field of Search ..... 399/66, 49, 72, 399/299, 303, 306

[56] References Cited

U.S. PATENT DOCUMENTS

| | | | |
|---|---|---|---|
| 5,294,959 | 3/1994 | Nagao et al. | 355/208 |
| 5,363,178 | 11/1994 | Matsumoto | 355/273 |
| 5,600,421 | 2/1997 | Takekoshi et al. | 399/66 |
| 5,930,556 | 7/1999 | Imamiya | 399/66 |
| 6,021,287 | 2/2000 | Tanaka | 399/66 |
| 6,029,022 | 2/2000 | Takase | 399/66 |

FOREIGN PATENT DOCUMENTS

| | | |
|---|---|---|
| 5-100578 | 4/1993 | Japan . |
| 5-119578 | 5/1993 | Japan . |
| 2642351 | 5/1997 | Japan . |

*Primary Examiner*—Richard Moses
*Attorney, Agent, or Firm*—Dike, Bronstein, Roberts & Cushman, LLP; David G. Conlin

[57] ABSTRACT

An image forming apparatus in which each test image formed in a plurality of image forming sections is transferred onto a transfer carrier belt by transfer means respectively provided corresponding to the plurality of image forming sections, and the transfer state is detected to control the image forming conditions, wherein the transfer condition of the respective transfer means is different when the test image is transferred onto the transfer medium and when the test images already formed and transferred in other image forming sections pass through the transfer means.

16 Claims, 9 Drawing Sheets

IMAGE FORMING APPARATUS

BACKGROUND OF THE INVENTION

1. Field of the Invention

The present invention relates to an image forming apparatus adopting an electrophotographic method such as a copying machine and a laser beam printer. More specifically, the present invention relates to an image forming apparatus capable of forming a multi-color image, comprising a plurality of image forming sections.

2. Description of the Prior Art

In a color image forming apparatus which is an image forming apparatus comprising a plurality of image forming sections, color images have been hitherto formed by superimposing various color images on a transfer member (recording material) in a sheet form. For example, with a digital color copying machine, a document image color-separated and input by a scanner is then subjected to a predetermined image processing. Thereafter, an image is formed for each color by a plurality of image forming sections provided for each color, and these images are superimposed on a recording paper to obtain one color image.

With these digital color copying machines, images of respective colors are faithfully reproduced and superimposed on a recording paper with high accuracy, hence a high grade image can be reproduced with high fidelity without impairing the image expression which the document image has.

Therefore, process control for controlling the image forming conditions in image forming sections, and resist adjustment for controlling the image forming position so that each color image is superimposed on the recording paper with high accuracy have been recently executed, so that color reproduction can be performed with high fidelity in the image forming sections for each color in order to output an image closer to the document image.

The technology relating to these process control and resist adjustment has been disclosed, for example, in Japanese Patent Application Laid-open Hei 5 No. 119578 and Hei 5 No. 100578, and Japanese Registered Patent Publication No. 2642351.

In Japanese Patent Application Laid-open Hei 5 No. 119578 and No. 100578, there is described an image forming apparatus which detects the toner density of a test image transferred for each image forming section immediately after the transfer to thereby control each image forming process.

Particularly, in Japanese Patent Application Laid-open Hei 5 No. 119578, it is described that the image density is properly controlled according to a density detection signal. In Japanese Patent Application Laid-open Hei 5 No. 100578, it is described that the transfer current of transfer means is controlled according to a density detection signal.

On the other hand, in Japanese Registered Patent Publication No. 2642351, it is described that test images formed in respective image forming sections are respectively transferred onto a transfer carrier belt, and each test image is read by a single sensor provided on the downstream side in the direction carrying a transfer medium, to determine the positional relationship of each test image, and to control the image forming position of each image forming section.

To perform the above described process control and resist adjustment with high accuracy, however, it is necessary to accurately read the density and forming position of each test image, which is formed by each image forming section and becomes a basis of the control and adjustment. That is to say, if read of the test image is incorrect, highly accurate control and adjustment cannot be performed.

According to the technique described in the above described Japanese Patent Application Laid-open Hei 5 No. 119578 and No. 100578, a sensor is provided for each image forming section so that a test image is read for each image forming section. Hence, it is useful from a standpoint that since an image formed in each image forming section and transferred onto the transfer carrier belt is read immediately after the transfer, the test image can be read with high accuracy.

If a plurality of sensors are used, however, there is a problem that the image is affected by the difference of detection results between respective sensors. Particularly, in the resist adjustment, the positional detection of each test image may be not correct due to the difference of the attached position between a plurality of sensors, hence the accuracy of the resist adjustment deteriorates. Moreover, since expensive sensors are arranged in plural numbers, cost increase cannot be avoided. Furthermore, there is another problem in that space and wiring for arranging a plurality of sensors and space for a circuit portion are required.

On the contrary, according to the technique described in Japanese Registered Patent Publication No. 2642351, detection is performed by a single sensor provided on the downstream side in the direction carrying a transfer medium, enabling to prevent the above described cost increase, difference of detection results between a plurality of sensors, and problems of additional space, which makes is useful.

However, it has a construction that a test image formed in each image forming section is sequentially transferred onto the transfer carrier belt. Therefore, it may cause such a situation that a test image formed in an image forming section on the upstream side and transferred onto the transfer carrier belt is re-transferred to a photosensitive material in an image forming section on the downstream side, when passing through the image forming section, resulting in a state different from that of at the time of transfer.

Below is a description of the mechanism and principle which cause the above described re-transfer. FIG. 1 shows a construction of one image forming section, which comprises, around a photosensitive drum 222, a charging process by means of an electric charger 223 for uniformly charging the photosensitive material surface to a predetermined electric potential; an image exposure recording process for writing an image; a development process by means of a developing device 224 for reproducing an image by adding a developer to a portion where the image has been written; a transfer process by means of a transfer device 225 for transferring the image reproduced on the photosensitive material 222 onto a transfer medium (a transfer carrier belt 216); a cleaning process by means of a cleaner 226 for enabling the next image forming by removing the developer remaining on the photosensitive material 222; and a discharging process by means of a discharger for removing the residual potential on the photosensitive material surface and enabling the stabilized next image forming. By repeating these processes, images are recorded.

In the conventional digital color copying machine, when a test image is formed on the transfer carrier belt 216, and the position of the test image is read to be resist adjusted, transfer voltage of +1.2 kV is always applied on the transfer means 225 even when the image is transferred from the photosensitive drum 222 and when the test image transferred on the transfer carrier belt 216 passes therethrough.

FIG. 2 shows the transition of the potential state on the photosensitive material 222 of the image forming section shown in FIG. 1. Next is a description of the transition by dividing it into (1) charging process, (2) exposure process, (3) development process, and (4) transfer process. (1) The surface of the photosensitive material 222 is uniformly charged to −500 V by the electric charger 223. (2) The potential of the photosensitive material where the image is written (image portion) drops to several tens V, causing the potential difference between the image portion and a non-image portion (the surface potential of the photosensitive material uniformly charged in the charging process drops gradually). (3)Developing bias of −200 V is applied to a developing roller to attach a negatively charged toner to the image portion on the photosensitive material 222 by stirring the toner and the carrier, so that the toner is attached only to the image portion which is on the 0 V side from −200 V (hatched area in FIG. 2). (4) Transfer bias of +1.2 kV is applied to the transfer device 225 to electrically draw the toner, in order to transfer the toner image attached on the photosensitive material 222 onto the transfer medium (transfer carrier belt 216).

Here, since voltage of +1.2 V is always applied to the transfer device, the photosensitive material surface is positively charged due to the high transfer bias. Therefore, the toner of the test image once transferred (the toner is negatively charged), or the toner of the test image transferred in the image forming section on the upstream side on the transfer medium 216 is drawn toward the photosensitive material in a portion after the transfer section of the photosensitive material 222 (a position in the vicinity where the photosensitive material 222 parts from the transfer carrier belt 216). In particular, with regard to the test image formed in the other image forming sections, the retaining force of the toner drops while being carried, hence those test images are easily drawn toward the photosensitive material 222.

The above is the mechanism for re-transfer of the image. If such re-transfer is caused in the test image for performing the process control and the resist adjustment, edges of the test image are blurred, and the position (or the pattern interval) cannot be detected accurately. Moreover, if the toner density becomes low, accurate density adjustment cannot be performed.

As a result, with the conventional construction, it cannot be said that detection of the test image is always correct, hence the control based on the detection is neither correct. Thus, there is a problem that a color image faithful to the document image cannot be reproduced.

SUMMARY OF THE INVENTION

It is therefore an object of the present invention to provide an image forming apparatus comprising a plurality of image forming sections, and having a construction that test images formed in each image forming section are sequentially transferred onto a transfer medium, wherein re-transfer of the test image can be prevented, and control of the image forming conditions such as accurate process control or resist adjustment can be conducted.

With a view to attaining the above object, the aspect of the present invention is as follows.

A first aspect of the present invention is an image forming apparatus in which each test image formed in a plurality of image forming sections is transferred onto a transfer medium by transfer means respectively provided corresponding to the plurality of image forming sections, and the transfer state is detected to control the image forming conditions, wherein the transfer condition of the respective transfer means is different when the test image is transferred onto the transfer medium and when test images already formed and transferred in other image forming sections pass through the transfer means.

A second aspect of the present invention is an image forming apparatus in which each test image formed in a plurality of image forming sections is transferred onto a transfer medium by transfer means respectively provided corresponding to the plurality of image forming sections, and the transfer state is detected to control the image forming conditions, wherein the transfer condition of the respective transfer means is different when the test image is transferred onto the transfer medium and when a normal image is transferred onto a transfer material supported on the transfer medium.

A third aspect of the present invention is an image forming apparatus according to the aspect one, wherein the detection means for detecting the transfer state is provided in a prescribed location on the downstream side of the above described image forming section, comprising a single detection section for detecting the above described each test image.

A fourth aspect of the present invention is an image forming apparatus according to the aspect two, wherein the detection means for detecting the transfer state is provided in a prescribed location on the downstream side of the above described image forming section, comprising a single detection section for detecting the above described each test image.

A fifth aspect of the present invention is an image forming apparatus according to the aspect one, wherein the transfer condition of the transfer means is the transfer voltage, and the transfer voltage when the test image passes through the transfer medium is lower than the transfer voltage when the test image is transferred onto the transfer medium.

A sixth aspect of the present invention is an image forming apparatus according to the aspect three, wherein the transfer condition of the transfer means is the transfer voltage, and the transfer voltage when the test image passes through the transfer medium is lower than the transfer voltage when the test image is transferred onto the transfer medium.

A seventh aspect of the present invention is an image forming apparatus according to the aspect four, wherein the transfer condition of the transfer means is the transfer voltage, and the transfer voltage when the test image passes through the transfer medium is lower than the transfer voltage when the test image is transferred onto the transfer medium.

An eighth aspect of the present invention is an image forming apparatus according to the aspect five, wherein the transfer voltage when the test image passes through the transfer medium is a voltage which does not exceed a voltage for starting discharge by means of the transfer means.

A ninth aspect of the present invention is an image forming apparatus according to the aspect six, wherein the transfer voltage when the test image passes through the transfer medium is a voltage which does not exceed a voltage for starting discharge by means of the transfer means.

A tenth aspect of the present invention is an image forming apparatus according to the aspect seven, wherein the transfer voltage when the test image passes through the transfer medium is a voltage which does not exceed a voltage for starting discharge by means of the transfer means.

An eleventh aspect of the present invention is an image forming apparatus according to the aspect two, wherein the transfer condition of the transfer means is the transfer voltage, and the transfer voltage when a normal image is transferred onto a transfer material supported on the transfer medium is higher than the transfer voltage when the test image is transferred onto the transfer medium.

A twelfth aspect of the present invention is an image forming apparatus according to the aspect three, wherein the transfer condition of the transfer means is the transfer voltage, and the transfer voltage when a normal image is transferred onto a transfer material supported on the transfer medium is higher than the transfer voltage when the test image is transferred onto the transfer medium.

A thirteenth aspect of the present invention is an image forming apparatus according to the aspect four, wherein the transfer condition of the transfer means is the transfer voltage, and the transfer voltage when a normal image is transferred onto a transfer material supported on the transfer medium is higher than the transfer voltage when the test image is transferred onto the transfer medium.

A fourteenth aspect of the present invention is an image forming apparatus according to the aspect eleven, wherein the transfer voltage when the normal image is transferred onto the transfer material supported on the transfer medium becomes higher as corresponding to the image forming section located on the downstream side in the moving direction of the transfer medium.

A fifteenth aspect of the present invention is an image forming apparatus according to the aspect twelve, wherein the transfer voltage when the normal image is transferred onto the transfer material supported on the transfer medium becomes higher as corresponding to the image forming section located on the downstream side in the moving direction of the transfer medium.

A sixteenth aspect of the present invention its an image forming apparatus according to the aspect thirteen, wherein the transfer voltage when the normal image is transferred onto the transfer material supported on the transfer medium becomes higher as corresponding to the image forming section located on the downstream side in the moving direction of the transfer medium.

DESCRIPTION OF THE PREFERRED EMBODIMENTS

(First Embodiment of the Present Invention)

As follows is a description of an embodiment of the present invention with reference to FIG. 3 to FIG. 10.

Figure 1:
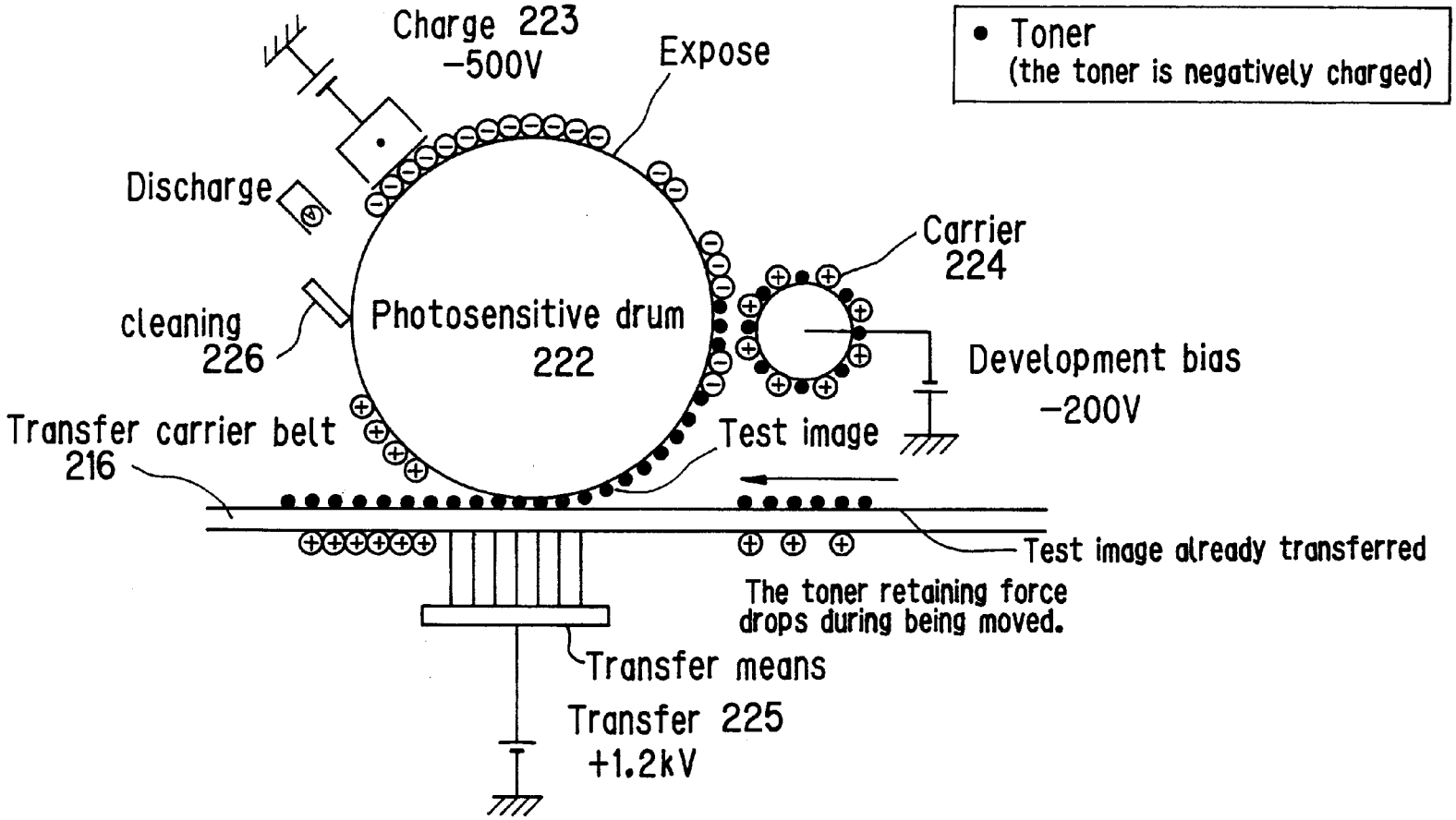
FIG. 1 PRIOR ART
FIG. 1 is a diagram showing one example of a construction of one image forming section and the process conditions in the prior art.
Figure 2:
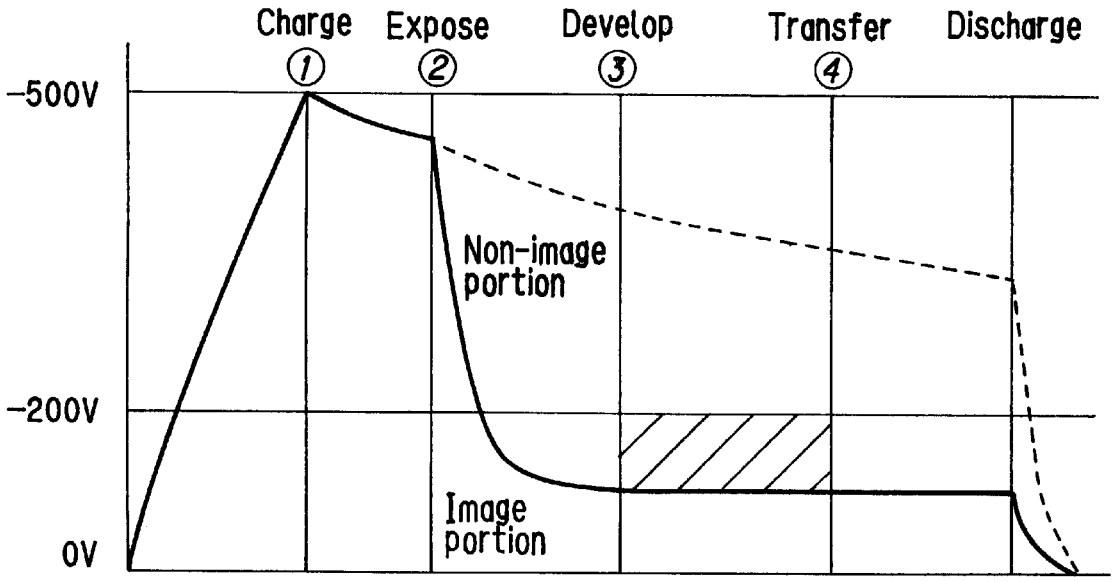
FIG. 2 PRIOR ART
FIG. 2 is a graph explaining a mechanism where a test image is re-transferred in the prior art.
Figure 3:
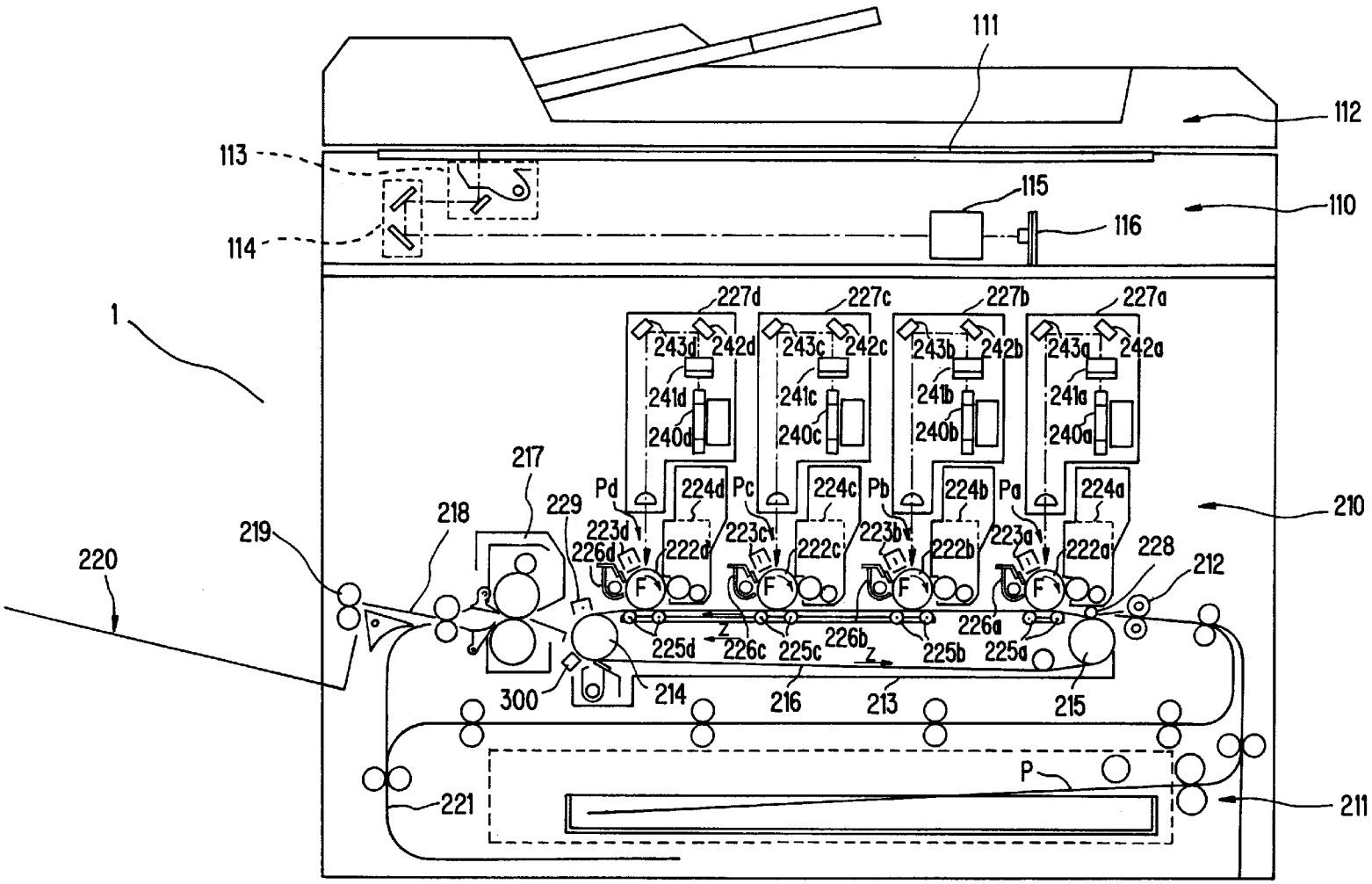
FIG. 3 is a sectional view showing the construction of a digital color copying machine according to an embodiment of the present invention.

FIG. 3 is a schematic diagram of a sectional view showing the construction of a digital color copying machine 1, which is an image forming apparatus according to a first embodiment of the present invention. The construction is such that on the upper side of the copying machine body 1, there are provided an original table 111 and an operation panel, and inside of the copying machine body 1, there are provided an image reading section 110 and the image forming section 210. On the upper side of the original table 111, there is mounted a recirculating automatic document feeder (RADF) 112 supported in a state that it can be opened and closed with respect to the original table 111 with a predetermined positional relation with respect to the face of the original table 111.

Moreover, the recirculating automatic document feeder 112 carries an original document so as to face the image reading section 110 at a predetermined position of the original table 111, and after the image of one side has been read, reverses the original document so that the other side thereof faces the image reading section 110 at the predetermined position and carries the document toward the original table 111. The recirculating automatic document feeder 112 then discharges the original document after images on both sides have been read with respect to one sheet of document, and performs the both-sides carrying operation for the next document. The above described operations for carrying the document and reversing the two sides are controlled with reference to the entire operation of the copying machine.

The image reading section 110 is arranged below the original table 111 to read the document image carried onto the original table 111 by the recirculating automatic document feeder 112. The image reading section 110 has document scanning bodies 113,114 which move back and forth in parallel along the lower face of the original table 111, an optical lens 115 and a CCD line sensor 116 serving as a photoelectric conversion element.

The document scanning bodies 113 and 114 comprise a first scanning unit 113 and a second scanning unit 114. The first scanning unit 113 has an exposure lamp for exposing a surface of the document image and a first mirror for deflecting a light image reflected from the document in the predetermined direction, and moves back and forth at a predetermined scanning speed in parallel with the lower face of the original table 111, while maintaining a certain distance with respect thereto. On the other hand, the second scanning unit 114 has second and third mirrors for deflecting the light image reflected from the document deflected by the first mirror of the first scanning unit 113 in the predetermined direction, and moves back and forth in parallel with the first scanning unit 113, keeping a certain speed relation.

The optical lens 115 reduces the light image reflected from the document deflected by the third mirror of the second scanning unit, and images the reduced light image at a predetermined position on the CCD line sensor 116.

The CCD line sensor 116 is a color CCD with three lines for photoelectrically converting the imaged light image sequentially into an electric signal and outputting the signal, which can read a black and white image or a color image, and output line data wherein the color is separated to each color component, for example, R (red), G (green) and B (blue). The document image information converted into an electric signal by the CCD line sensor 116 is transferred to an image forming section (not shown), and subjected to a predetermined image data processing.

Next is a description of the construction of the image forming section 210, and the construction of respective sections relating to the image forming section 210.

Under the image forming section 210, there is provided a paper feed mechanism 211 for separating papers (recording media) P loaded in a paper tray, one by one, and feeding it toward the image forming section 210. The paper P separated and fed one by one is carried to the image forming section 210, after the timing is controlled by a pair of resist rollers 212 arranged in front of the image forming section 210. The paper P on one side on which an image has been formed, is re-fed and carried to the image forming section 210 with the timing adjusted to the image forming in the image forming section 210.

Under the image forming section 210, there is arranged a transfer carrier belt mechanism 213. The transfer carrier belt mechanism 213 has such a construction that the paper P is electrostatically attracted and carried by a transfer carrier belt 216 laid across in a tensioned condition so as to extend roughly in parallel between a drive roller 214 and a driven roller 215. A pattern image detecting unit 300 is provided in close proximity on the lower side of the transfer carrier belt 216.

Moreover, on the downstream side of the transfer carrier belt mechanism 213 in the paper carrier passage, there is provided a fixing apparatus 217 for fixing the toner image transferred and formed on the paper P. The paper P passing through a nip between a pair of fixing rollers of the fixing apparatus 217 passes through a carrier direction change gate 218, and is discharged onto a discharged paper tray 220 attached on the outer wall of the copying machine body 1 by discharge rollers 219.

The direction change gate 218 is for selectively changing the carrier route of the paper P after fixing, either to a route for discharging the paper P to the discharge paper tray 220 of the copying machine body 1 or to a route for re-feeding the paper P toward the image forming section 210. The paper P whose direction is changed toward the image forming section 210 again by the change gate 218 is re-fed to the image forming section 210, after the inside and outside are reversed via a switch back carrier route 221.

On the upper side of the transfer carrier belt 216 in the image forming section 210, there are provided a first image forming station Pa, a second image forming station Pb, a third image forming station Pc, and a fourth image forming station Pd in proximity in a row arrangement, in the order from the upstream side of the paper carrier route, in close proximity to the transfer carrier belt 216.

The transfer carrier belt 216 is friction driven by the drive roller 214, in the direction shown by an arrow Z in FIG. 3, grabs the paper P fed through the feed mechanism 211 as described above, and carries the paper P sequentially to the image forming stations Pa to Pd.

Respective image stations Pa to Pd have substantially the same construction, and respective image stations Pa, Pb, Pc and Pd include photosensitive drums 222*a,* 222*b,* 222*c* and 222*d,* respectively, which are rotated in the direction of an arrow F shown in FIG. 3.

In the periphery of respective photosensitive drums 222*a,* 222*b,* 222*c* and 222*d,* there are arranged in order along the rotation direction of the photosensitive drums 222*a,* 222*b,* 222*c* and 222*d:* electric chargers 223*a,* 223*b,* 223*c* and 223*d* for uniformly charging the photosensitive drums 222*a* to 222*d;* developing devices 224*a,* 224*b,* 224*c* and 224*d* for respectively developing an electrostatic latent image formed on the photosensitive drums 222*a* to 222*d;* transfer discharges 225*a,* 225*b,* 225*c* and 225*d* for transferring the developed toner image on the photosensitive drums 222*a* to 222*d* to the paper P; and cleaning devices 226*a,* 226*b,* 226*c* and 226*d* for removing the toner remaining on the photosensitive drums 222*a* to 222*d.*

Moreover, on the upper side of the photosensitive drums 222*a* to 222*d,* there are provided laser beam scanner units 227*a,* 227*b,* 227*c* and 227*d,* respectively. The laser beam scanner units 227*a* to 227*d* comprise a semiconductor laser element (not shown) for emitting dot light modulated according to the image data; polygon mirrors (deflection devices) 240*a* to 240*d* for deflecting the laser beam from the semiconductor laser element to the main scanning direction; fθ lenses 241*a* to 241*d* for imaging the laser beam deflected by the polygon mirrors 240 on the surface of the photosensitive drums 222*a* to 222*d;* and mirrors 242*a* to 242*d,* 243*a* to 243*d.*

To the laser beam scanner 227*a* is input a pixel signal corresponding to a black color component image of the color document image, to the laser beam scanner 227*b* is input a pixel signal corresponding to a cyan color component image of the color document image, to the laser beam scanner 227*c* is input a pixel signal corresponding to a magenta color component image of the color document image, and to the laser beam scanner 227*d* is input a pixel signal corresponding to a yellow color component image of the color document image, respectively.

Electrostatic latent images corresponding to the document image information color-converted thereby are formed on respective photosensitive drums 222*a* to 222*d.* A black toner is housed in the developing device 227*a,* a cyan toner is in the developing device 227*b,* a magenta toner is in the developing device 227*c,* and a yellow toner is in the developing device 227*d,* respectively, and the electrostatic latent images on the photosensitive drums 222*a* to 222*d* are developed with these toners. Hence, the document image information color-converted by the image forming section 210 is reproduced as the toner image of each color.

Furthermore, between the first image forming station Pa and the feed mechanism 211, there is provided a paper attracting (brush) charger 228, and this attracting charger 228 charges the surface of the transfer carrier belt 216, and the paper P fed from the feed mechanism 211 is carried from the first image forming station Pa to the fourth image forming station Pd, without getting out of position, in a state reliably attracted on the transfer carrier belt 216.

On the other hand, a discharger 229 is provided right above the drive roller 214 between the fourth image station Pd and the fixing apparatus 217. This discharger 219 is charged with alternating current for separating the paper P electrostatically attracted to the carrier belt 216 from the transfer carrier belt 216.

In the digital color copying machine with the above construction, papers in a form of cut sheet are used as the paper P. When this paper P is fed out from the paper feed cassette into a guide in the paper feed carrier route of the paper feed mechanism 211, the tip portion of the paper P is detected by a sensor (not shown), and based on the detection signal output from the sensor, the paper P is temporarily stopped by a pair of resist rollers 212.

Then, the paper P is fed onto the transfer carrier belt 216 rotating in the direction of an arrow Z in FIG. 3, with the timing adjusted with respective image stations Pa to Pd. Meanwhile, since a predetermined electric charge is applied to the transfer carrier belt 216 by the attracting charger 228, as described above, the paper P is stably carried and fed, while passing through respective image stations Pa to Pd.

In respective image stations Pa to Pd, a toner image of each color is respectively formed, and superimposed on a support face of the paper P electrostatically attracted and carried by the transfer carrier belt 216. When the image transfer by means of the fourth image station Pd has been completed, the paper P is discharged and peeled from the transfer carrier belt 216 by means of the discharger 229 for discharging, in order from the front end thereof, and guided to the fixing apparatus 217. Finally, the paper P on which the toner image is fixed is discharged from the paper discharge port (not shown) onto the discharged paper tray 220.

In the above description, the construction is such that by means of the laser beam scanner units 227*a* to 227*d*, the laser beam is scanned and exposed, to thereby perform optical writing onto the photosensitive material. However, an optical writing system (LED head) comprising a light-emitting diode array and a focusing lens array may be used instead of the laser beam scanner units. The LED head has a smaller size compared to the laser beam scanner units, without having a movable portion, and hence without any noise. Therefore, it can be used preferably in an image forming apparatus such as a tandem-type digital color copying machine which requires a plurality of optical writing units.

Next is a description of the construction relating to characteristics of the present invention, with reference to FIG. 4 to FIG. 10.

Figure 4:
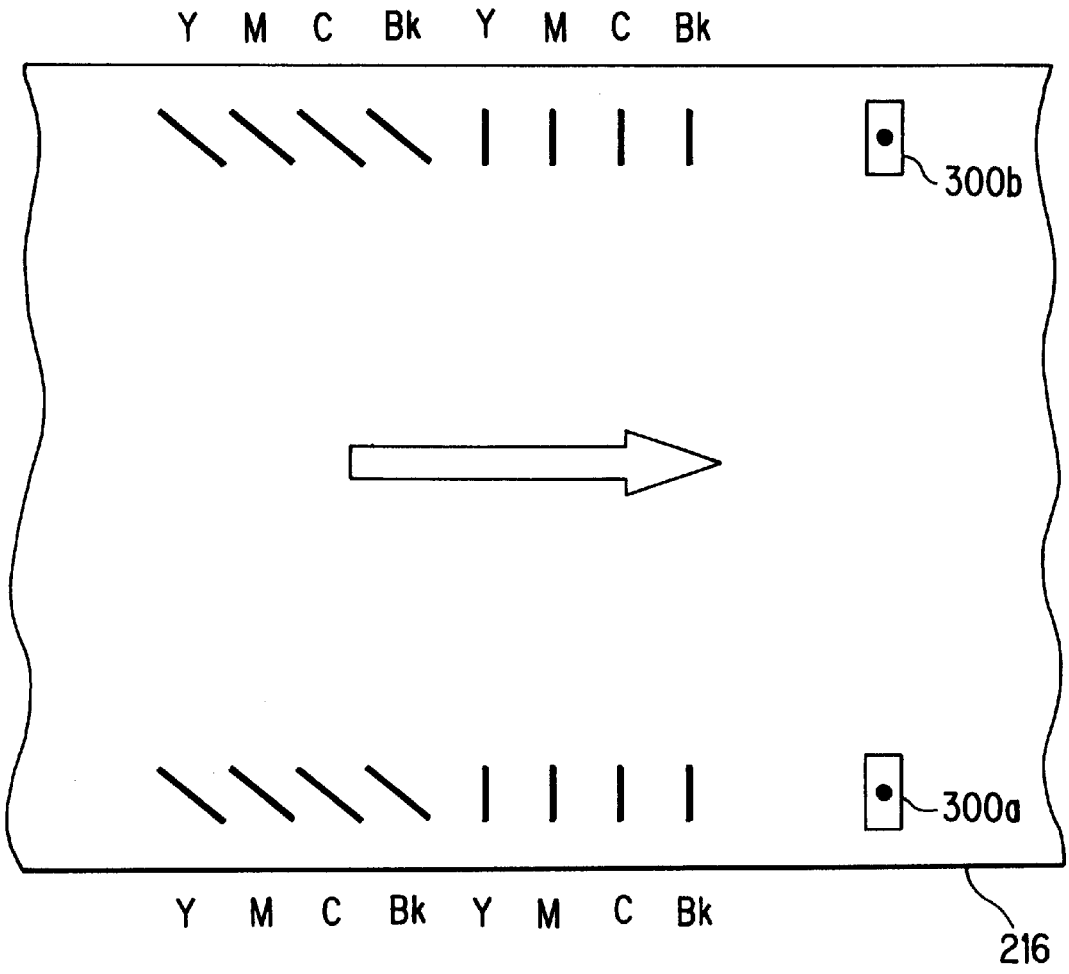
FIG. 4 is a diagram for explaining a test image according to an embodiment of the present invention.

With the digital color copying machine in this embodiment, for example, when the power of the copying machine body is ON (at the time of start-up), a test image as shown in FIG. 4 is directly formed on the transfer carrier belt 216 by respective image forming stations Pa to Pd, and the resist adjustment is performed for adjusting the image forming position in the respective image forming stations, using the test image.

The test image is formed in the non-image forming section on the both ends of the transfer carrier belt 216, and comprises a horizontal pattern and a slant pattern of each color. These patterns are read, respectively, by a set of detection sensors 300 (300*a* and 300*b*) provided in a prescribed location opposite to the drive roller 214 of the transfer carrier belt 216. The detection sensors 300 are composed of optical sensors.

Figure 5:
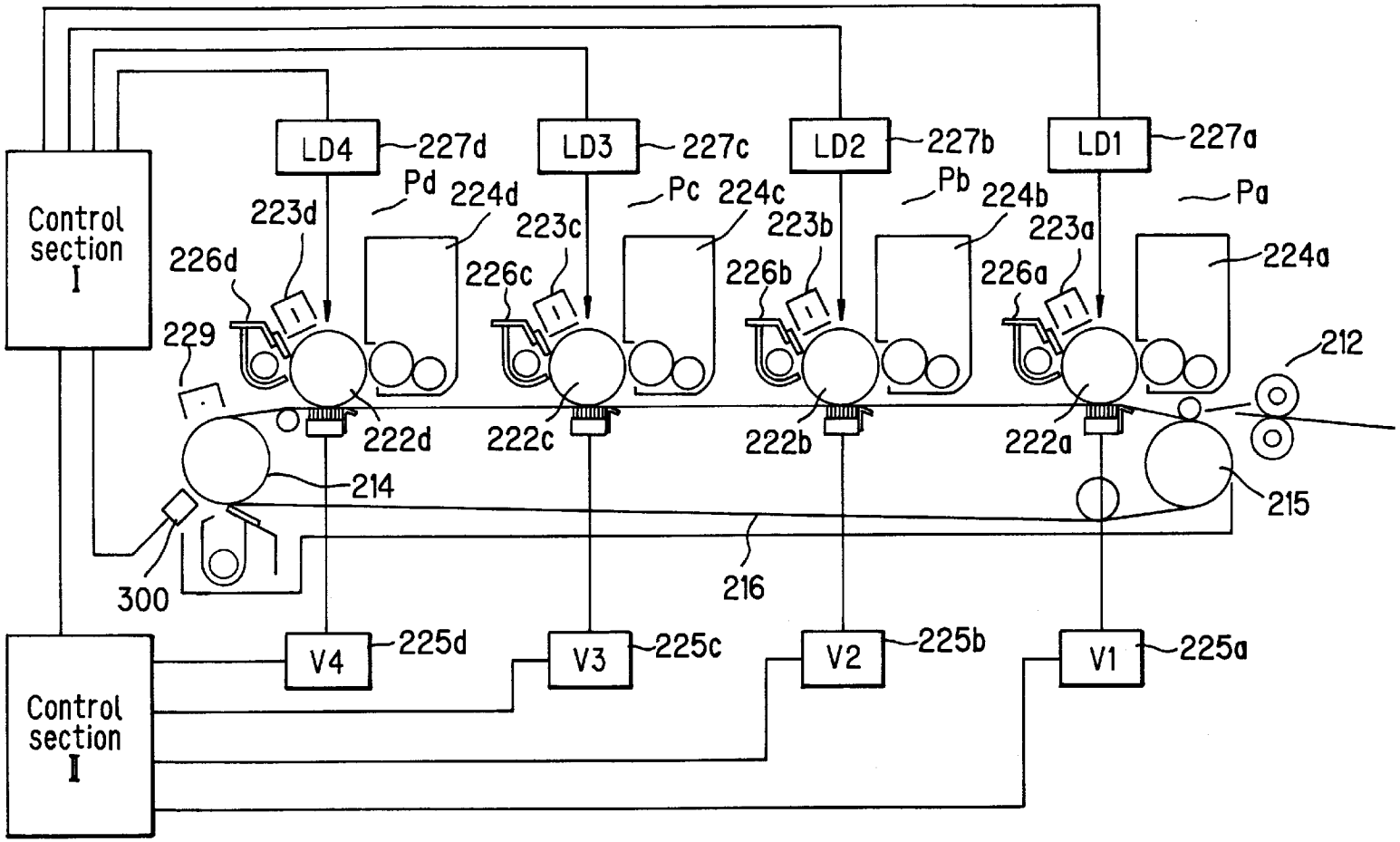
FIG. 5 is a diagram showing the relations between a laser beam scanner unit, a transfer discharger, a control section I and a control section II of each image forming section, according to an embodiment of the present invention.

As shown in FIG. 5, the control section I is so constructed as to control the laser beam scanner units 227 of respective image forming stations based on the detection results of the detection sensors 300, to thereby perform adjustment of recording start position and adjustment of magnification. The resist adjustment using these patterns is described in detail in, for example, Japanese Registered Patent Publication No. 2642351, hence the description thereof will be omitted.

As described in the section of Description of the Prior Art, with the conventional digital color copying machine, there is a problem that even if an attempt is made to perform the resist adjustment, a test image is re-transferred before arriving at the detection position of the sensor 300.

Therefore, with the digital color copying machine in this embodiment, a control section II shown in FIG. 5 controls the voltage applied to the transfer discharger 225 corresponding to the respective image forming stations, and when a test image formed in the image forming station is transferred, transfer bias for transferring a normal test image is applied to the corresponding transfer discharger 225 to thereby reliably transfer the test image on the transfer carrier belt 216. Meanwhile, when a test image already transferred in the other image forming station onto the transfer carrier belt 216 passes therethrough, transfer bias only for maintaining the test image on the transfer carrier belt 216 is applied.

Thereby, it becomes possible to reliably transfer the test image onto the transfer carrier belt 216, and with regard to the test image formed in the other image forming stations and already transferred, it becomes possible to pass the image safely without being re-transferred onto the photosensitive material.

Figure 8:
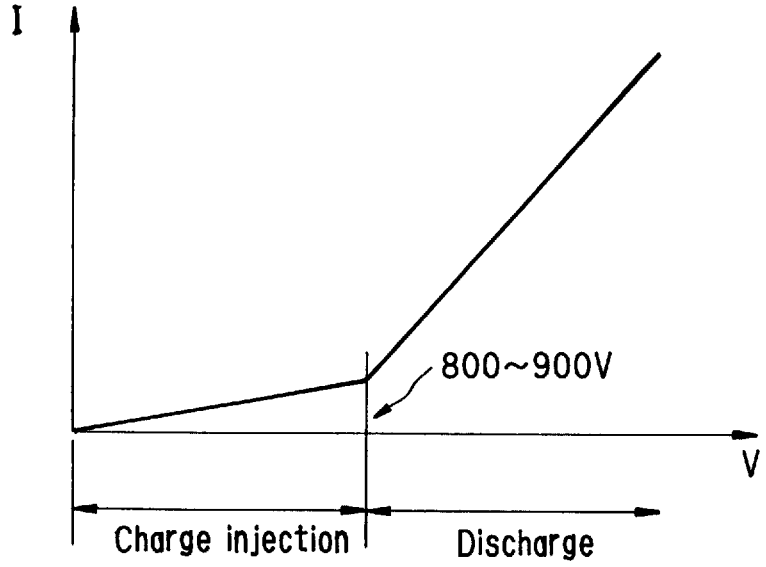
FIG. 8 is a graph showing the relations between a transfer discharge voltage, a discharge starting voltage and the transfer current, according to an embodiment of the present invention.

FIG. 8 is for explaining one example of a setting standard of the transfer bias to be changed over. If the voltage V applied to the transfer discharger is increased, electric charge will be discharged at 800 to 900 V and discharge current I will flow, but the electric charge is injected up to 800 V. Therefore, it is so explained in this embodiment that discharge is caused at the applied voltage of from 800 to 900 V, but depending upon the materials to be used, the interval, the environment to be used, and the like, these values will vary. Hence, the relation between the discharge current and the discharge voltage may be determined in advance depending upon the apparatus used, and these values may be properly set for each apparatus.

Therefore, with the transfer discharger 225 corresponding to the respective image forming stations, transfer bias lower than that of at the time of transferring a test image is applied so that a test image transferred in the other image forming stations is not re-transferred on the photosensitive material 222, that is, when it is not related to the transfer of a test image, a toner on the transfer carrier belt 216 is not attracted by charging the surface of the photosensitive material 222 by the discharge of the transfer discharger 225. Preferably, voltage not higher than the discharge starting voltage for starting discharge is applied.

Hence, the electric potential on the back side of the transfer medium whose toner retaining force has dropped gradually during being moved from the back side of the transfer carrier belt 216 from the upstream side can be restored to some extent in the transfer section on the downstream side. As a result, a test image once transferred can be carried to the detection sensor 300 on the downstream side without being affected by the transfer process corresponding to the image forming station on the downstream side.

Figure 6:
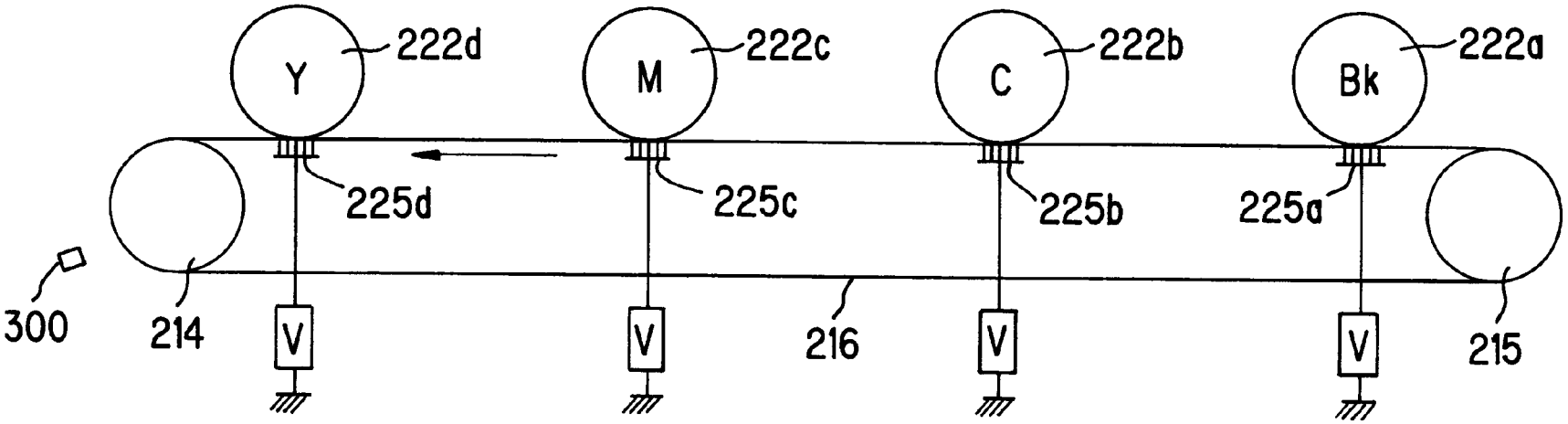
FIG. 6 is a diagram for explaining the relations between the transfer output values during forming an image, during forming a test image, and while the test images in other colors are passing through the transfer section, in the transfer section of each image forming section, according to an embodiment of the present invention.

FIG. 6 shows positional relations between transfer dischargers 225*a* to 225*d* corresponding to the respective image forming stations in the above described digital color copying machine, and Table 1 shows the applied voltage value. Each transfer discharger is applied with a transfer bias of 1.2 kV at the time of transfer of a test image. Except of the transfer discharger 225*a* corresponding to black provided in a prescribed location on the uppermost-stream side, when a test image in other colors (slant pattern, horizontal pattern) passes through the transfer dischargers, the transfer voltage is changed to 0.8 kV.

TABLE 1

| | Y | M | C | Bk |
|---|---|---|---|---|
| During image formation | 2.1 kV | 1.9 kV | 1.7 kV | 1.5 kV |
| During test image formation | 1.2 kV | 1.2 kV | 1.2 kV | 1.2 kV |
| During test image formation of other colors | 0.8 kV | 0.8 kV | 0.8 kV | — |

Figure 7A:
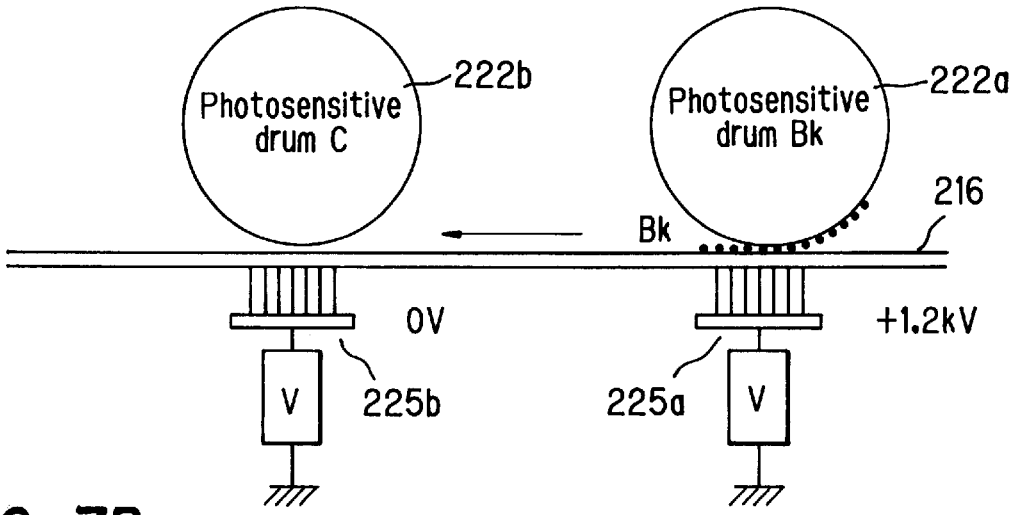
FIGS. 7A–7C are diagrams showing relations between the transfer output values in transfer sections of image forming sections for black and cyan, according to an embodiment of the present invention.
Figure 7B:
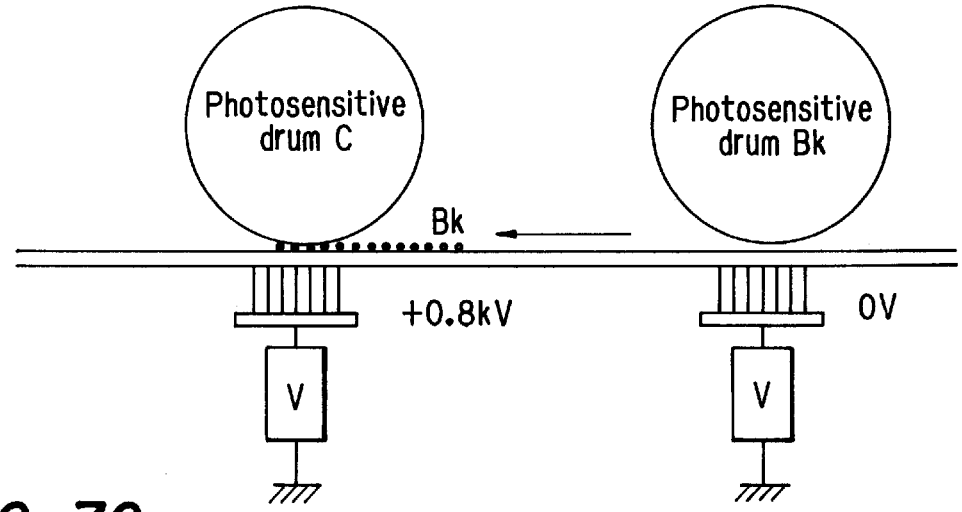
Figure 7C:
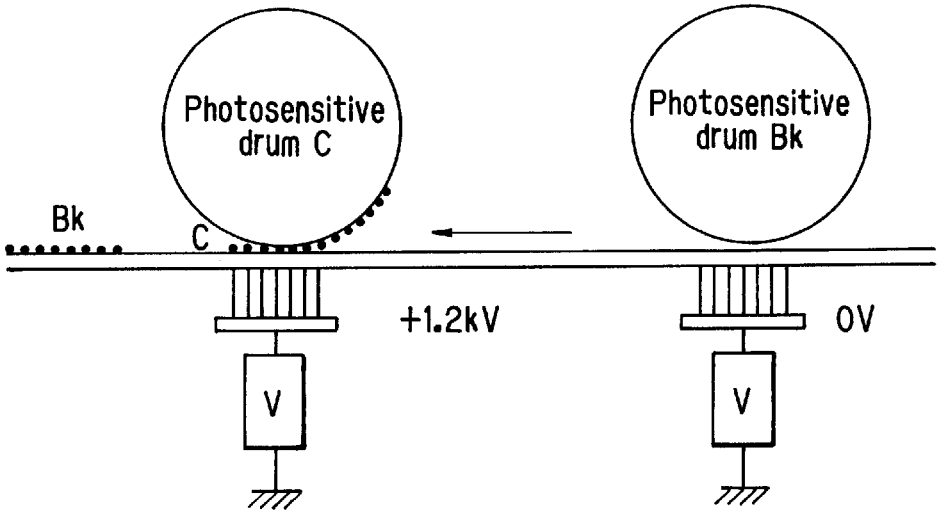

FIG. 7A to FIG. 7C show the state how a test image formed in the image forming station Pa for black passes through the image forming station Pb for cyan.

FIG. 7A: A test image formed in Pa is transferred onto the transfer carrier belt 216 by the photosensitive material 222*a* at a transfer bias of +1.2 kV. At this time, voltage is not applied to the transfer discharger 225*b* for cyan.

FIG. 7B: When the black test image reaches the vicinity of the cyan transfer section, a transfer voltage of +0.8 kV is applied to the transfer discharger 225 for cyan. Thereby, the black test image passes through the cyan transfer section without being re-transferred to the photosensitive material 222*b* for cyan, and the retaining force to the transfer carrier belt 216 which has been weakened during being carried can be restored.

FIG. 7C: Only when a cyan test image is transferred on the transfer carrier belt 216, a transfer bias of +1.2 kV is applied.

As shown in FIG. 6, in the digital color copying machine, a transfer bias during a normal image is formed is set higher than a transfer bias at the time of forming a test image. This is because a normal image is formed on a transfer material P such as a paper or the like supported on the transfer carrier belt 216, while a test image is directly formed on the transfer carrier belt 216.

As described above, by changing the transfer bias at the time of transferring a test image and at the time of transferring a normal image, both the test image and the normal image can be transferred under the optimum conditions corresponding thereto.

Moreover, the transfer bias during forming a normal image is preferably set to become higher as going to the downstream side. This is because of considering electric charge which is accumulated while the transfer material passes through the transfer area of each image forming section, since the transfer material P exists between the photosensitive material 222 and the transfer carrier belt 216. By increasing the transfer voltage by the accumulated amount of electric charge, excellent image transfer can be realized in the respective image forming stations from the upstream side to the downstream side.

The values exemplified in this embodiment, that is, discharge starting voltage, actual transfer bias and the like will vary depending upon various conditions such as mechanical conditions and materials of the transfer means, materials of the transfer medium, and development process conditions. The values used herein are: resistance value of the transfer carrier belt: $10^{13}$ ohm, the thickness: 100 micron, and the resistance value of the transfer discharger: from $10^4$ to $10^7$ ohm.

(Second Embodiment of the Present Invention)

Figure 9:
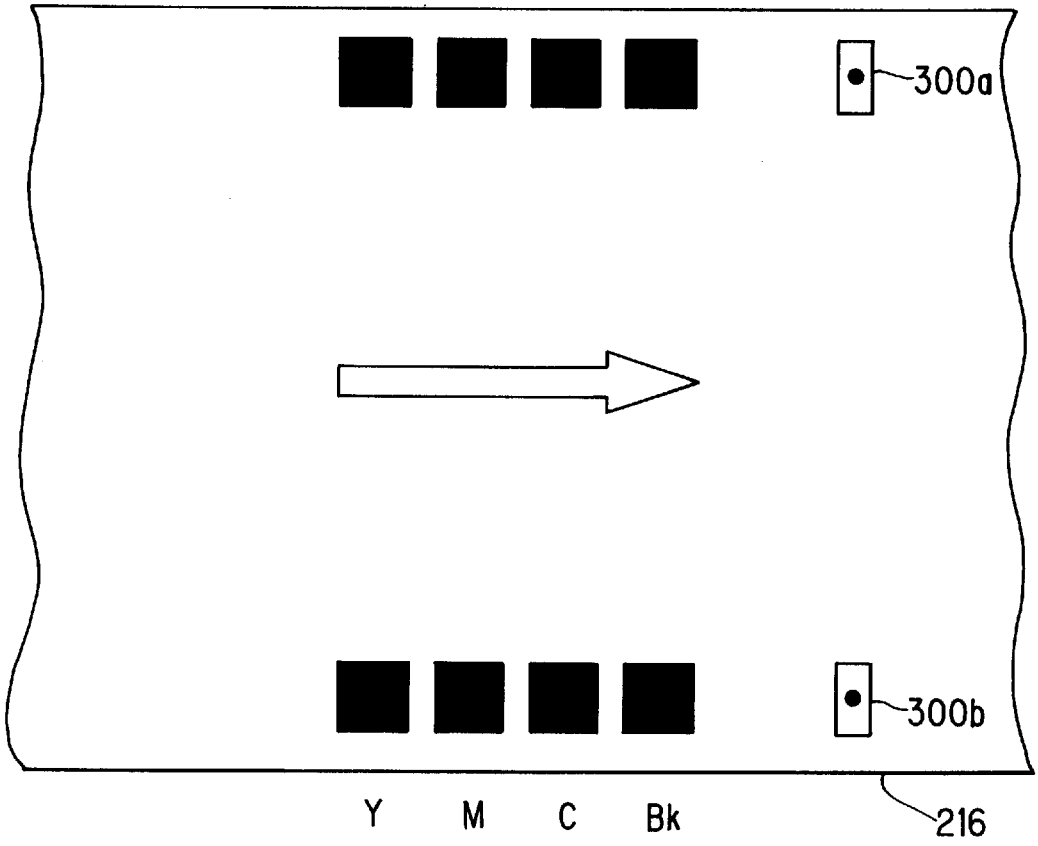
FIG. 9 is a diagram for explaining a test image according to a second embodiment of the present invention.
Figure 10:
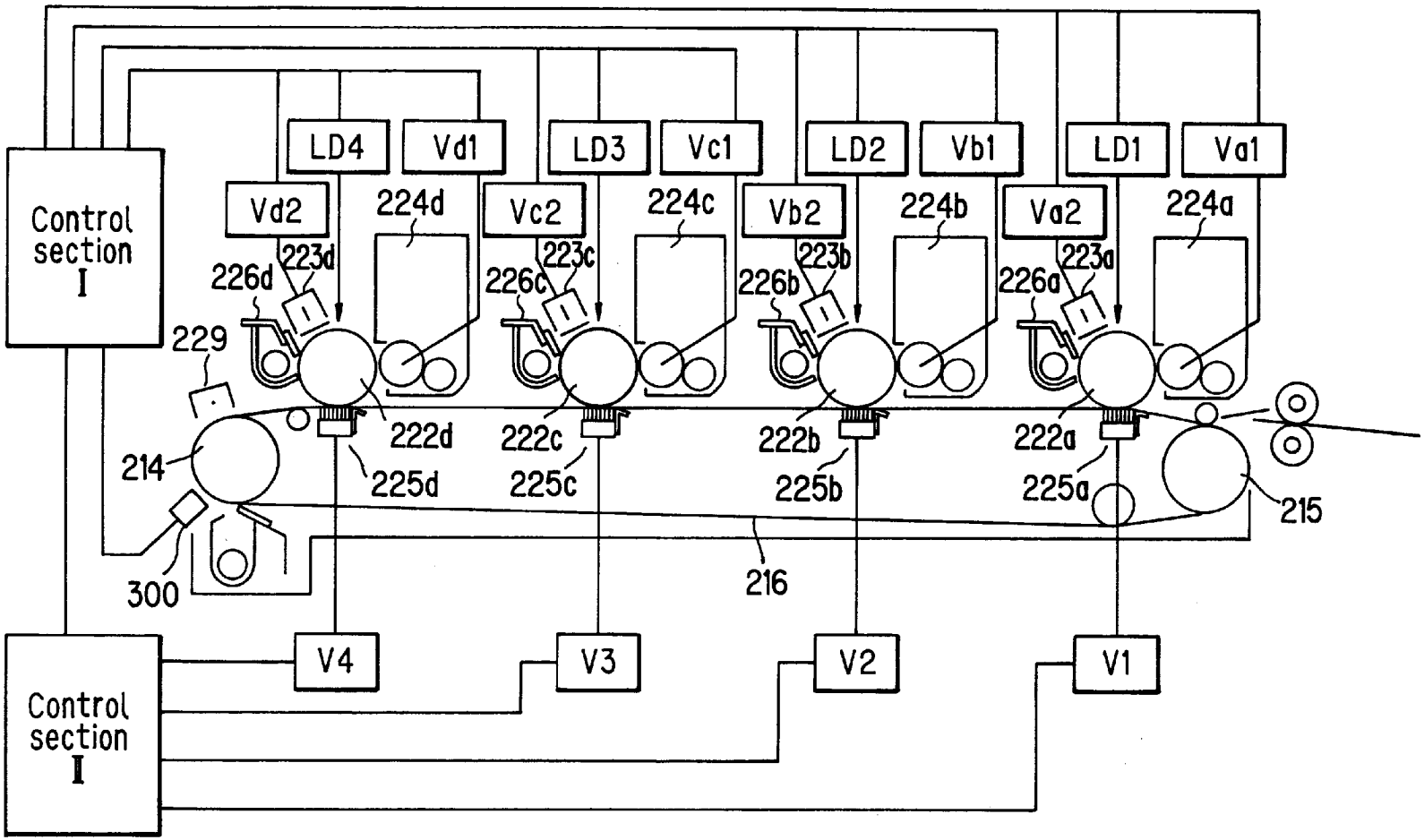
FIG. 10 is a diagram showing the relations between a laser beam scanner unit, a transfer discharger, an electric charger, a developing bias, a control section I and a control section II of each image forming section, according to an embodiment of the present invention.

The follows is a description of another embodiment according to the present invention with reference to FIG. 9 and FIG. 10.

The main construction of the digital color copying machine of this embodiment is similar to that of the first embodiment, but a test image for controlling the imaging conditions as shown in FIG. 9 is formed, the density of each color pattern is detected, and the control section I shown in FIG. 10 controls the charge voltage (V2) in the charger, the exposure action in the laser scanner unit (LD) or the development bias (V1) in the developing apparatus for each image forming station. This process control is described in detail in Japanese Patent Application Laid-open Hei 5 No. 110578, hence detailed description will be omitted.

Also in this digital color copying machine, the control section II controls the voltage applied to the transfer discharger 225 corresponding to the respective image forming stations, to form a test image, and changes the voltage (transfer bias) applied depending upon cases, for example when a test image passes therethrough, or when a normal image is formed. Hence, the density of each pattern in the test image can be accurately detected, enabling accurate process control.

The resist adjustment and process control described in the above embodiments show only an example of the present invention. In a so-called tandem-type digital color copying machine, by adopting an applied bias control at the time of transferring a test image and at the time when a test image is passing therethrough, a test image can be detected without becoming faint or having unclear edges, in just the state it was formed in the respective image forming stations and transferred onto the transfer carrier belt, as if a detection sensor is arranged for each image forming station. Hence, very accurate resist adjustment and process control, and imaging condition control can be performed. It is also possible to prevent the influence of the difference in each sensor, as in the case where a detection sensor is arranged for each image forming station, space increase, cost increase and the like.

The image forming apparatus according to the aspect one is characterized in that a test image formed in a plurality of image forming sections is transferred onto a transfer medium by transfer means respectively provided corresponding to the plurality of image forming sections, and the transfer state is detected to control the image forming conditions, wherein the transfer condition of the respective transfer means is different when the test image is transferred onto the transfer medium and when test images already formed and transferred in other image forming sections pass through the transfer means.

Accordingly, when the test image formed in the image forming section on the upstream side in the moving direction of the transfer medium and transferred onto the transfer medium passes through the transfer portion of the image forming section located downstream side thereof, the test image can pass through the transfer portion in a state reliably held on the transfer medium, without being re-transferred on the photosensitive material of the image forming section located in that position. Hence each test image can be guided to the sensor in just the state it was transferred by the transfer means corresponding to the respective image forming sections and can be detected, thus the control of imaging conditions performed based on the detection results and process control can be accurately performed, to thereby provide a high-quality image. Moreover, distinguished effect can be obtained that the control of image forming position performed based on the detection results, so called resist adjustment becomes very accurate, enabling to provide a high quality image.

The image forming apparatus according to the aspect two is an image forming apparatus characterized in that each test image formed in a plurality of image forming sections is transferred onto a transfer medium by transfer means respectively provided corresponding to the plurality of image forming sections, and the transfer state is detected to control the image forming conditions, wherein the transfer condition of the respective transfer means is different when the test image is transferred onto the transfer medium from when a normal image is transferred onto a transfer material supported on the transfer medium.

Accordingly, by changing the transfer condition between transferring of a test image and transferring of a normal image, the test image and the normal image can be transferred under the optimum conditions corresponding thereto. As a result, process control and resist adjustment based on the test image can be more accurately performed, and the normal image can be exhibited with high grade.

The image forming apparatus according to the aspects three and four is an image forming apparatus according to the aspect one or two wherein the detection means for detecting the transfer state is provided in a prescribed location on the downstream side of the above described image forming section, comprising a single detection section for detecting the above described each test image, hence a plurality of test images are detected by a common sensor. Therefore, an influence of difference between detection results by respective sensors caused when a plurality of test images are detected by different sensors, and problems such as cost increase and increase of space for wiring and a substrate can be eliminated, as well as detection under the same conditions becomes possible, as a result, accurate adjustment becomes possible.

The image forming apparatus according to the aspects five, six and seven is an image forming apparatus according to the aspects one, three and four, wherein the transfer condition of the transfer means is the transfer voltage, and the transfer voltage when the test image passes through the transfer medium is lower than the transfer voltage when the test image is transferred onto the transfer medium. Hence, it has such an effect that the change of transfer condition can be specifically realized such that the re-transfer of the test image is not caused, as described in the aspects one, three and four.

The image forming apparatus according to the aspects eight, nine and ten is an image forming apparatus according to the aspects five, six and seven, wherein the transfer voltage when the test image passes through the transfer medium is a voltage which does not exceed a voltage for starting discharge by means of the transfer means. Hence, it has such an effect that re-transfer to the photosensitive material can be reliably prevented.

The image forming apparatus according to the aspects eleven, twelve and thirteen is an image forming apparatus according to the aspects two, three and four, wherein the transfer condition of the transfer means is the transfer voltage, and the transfer voltage when a normal image is transferred onto a transfer material supported on the transfer medium is higher than the transfer voltage when the test image is transferred onto the transfer medium. Hence, it becomes possible to transfer a test image and a normal image described in the aspects two, three and four in an optimum state.

The image forming apparatus according to the aspects fourteen, fifteen and sixteen is an image forming apparatus according to the aspects eleven, twelve and thirteen, wherein the transfer voltage when the normal image is transferred onto the transfer material supported on the transfer medium becomes higher as corresponding to the image forming section located on the downstream side in the moving direction of the transfer medium. When an image is transferred to a transfer material supported on a transfer medium, since the transfer material exists between the photosensitive material and the transfer medium, electric charge is accumulated every time the transfer material passes through the transfer area of the respective image forming section. Therefore, according to the construction of the aspects fourteen, fifteen and sixteen, the transfer voltage is increased by the accumulated amount of electric charge, to thereby realize excellent image transfer.

What is claimed is:

1. An image forming apparatus in which each test image formed in a plurality of image forming sections is transferred onto a transfer medium by transfer means respectively provided corresponding to the plurality of image forming sections, and the transfer state is detected to control the image forming conditions, wherein the transfer condition of said respective transfer means is different when said test image is transferred onto the transfer medium and when said test images already formed and transferred in other image forming sections pass through the transfer means.

2. An image forming apparatus according to claim 1, wherein the detection means for detecting the transfer state is provided in a prescribed location on the downstream side of said image forming section, comprising a single detection section for detecting said each test image.

3. An image forming apparatus according to claim 1, wherein the transfer condition of the transfer means is the transfer voltage, and the transfer voltage when said test image passes through the transfer medium is lower than the transfer voltage when said test image is transferred onto the transfer medium.

4. An image forming apparatus according to claim 2, wherein the transfer condition of the transfer means is the transfer voltage, and the transfer voltage when said test image passes through the transfer medium is lower than the transfer voltage when said test image is transferred onto the transfer medium.

5. An image forming apparatus according to claim 3, wherein the transfer voltage when said test image passes through the transfer medium is a voltage which does not exceed a voltage for starting discharge by means of said transfer means.

6. An image forming apparatus according to claim 4, wherein the transfer voltage when said test image passes through the transfer medium is a voltage which does not exceed a voltage for starting discharge by means of said transfer means.

7. An image forming apparatus according to claim 2, wherein the transfer condition of the transfer means is the transfer voltage, and the transfer voltage when a normal image is transferred onto a transfer material supported on the transfer medium is higher than the transfer voltage when said test image is transferred onto the transfer medium.

8. An image forming apparatus according to claim 7, wherein the transfer voltage when the normal image is transferred onto the transfer material supported on the transfer medium becomes higher as corresponding to the image forming section located on the downstream side in the moving direction of the transfer medium.

9. An image forming apparatus in which each test image formed in a plurality of image forming sections is transferred onto a transfer medium by transfer means respectively provided corresponding to the plurality of image forming sections, and the transfer state is detected to control the image forming conditions, wherein the transfer condition of said respective transfer means is different when said test image is transferred onto the transfer medium and when a normal image is transferred onto a transfer material supported on the transfer medium.

10. An image forming apparatus according to claim 9, wherein the detection means for detecting the transfer state is provided in a prescribed location on the downstream side of said image forming section, comprising a single detection section for detecting said each test image.

11. An image forming apparatus according to claim 10, wherein the transfer condition of the transfer means is the transfer voltage, and the transfer voltage when said test image passes through the transfer medium is lower than the transfer voltage when said test image is transferred onto the transfer medium.

12. An image forming apparatus according to claim 11, wherein the transfer voltage when said test image passes through the transfer medium is a voltage which does not exceed a voltage for starting discharge by means of said transfer means.

13. An image forming apparatus according to claim 9, wherein the transfer condition of the transfer means is the transfer voltage, and the transfer voltage when a normal image is transferred onto a transfer material supported on the transfer medium is higher than the transfer voltage when said test image is transferred onto the transfer medium.

14. An image forming apparatus according to claim 10, wherein the transfer condition of the transfer means is the transfer voltage, and the transfer voltage when a normal image is transferred onto a transfer material supported on the transfer medium is higher than the transfer voltage when said test image is transferred onto the transfer medium.

15. An image forming apparatus according to claim 13, wherein the transfer voltage when the normal image is transferred onto the transfer material supported on the transfer medium becomes higher as corresponding to the image forming section located on the downstream side in the moving direction of the transfer medium.

16. An image forming apparatus according to claim 14, wherein the transfer voltage when the normal image is transferred onto the transfer material supported on the transfer medium becomes higher as corresponding to the image forming section located on the downstream side in the moving direction of the transfer medium.

* * * * *